US010086967B2

(12) United States Patent
Bacallao

(10) Patent No.: US 10,086,967 B2
(45) Date of Patent: Oct. 2, 2018

(54) RETRACTABLE BAGGING STATION

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/798,642

(22) Filed: Oct. 31, 2017

(65) Prior Publication Data

US 2018/0148210 A1 May 31, 2018

Related U.S. Application Data

(60) Provisional application No. 62/426,633, filed on Nov. 28, 2016.

(51) Int. Cl.

| | |
|---|---|
| ***A47F 9/00*** | (2006.01) |
| ***B65B 67/12*** | (2006.01) |
| ***A47F 9/04*** | (2006.01) |

(52) U.S. Cl.

CPC ..... *B65B 67/1266* (2013.01); *A47F 9/043* (2013.01); *B65B 67/1227* (2013.01); *B65B 67/1216* (2013.01)

(58) Field of Classification Search

CPC .. A47F 9/00; A47F 9/005; A47F 9/042; A47F 9/043; A47F 5/13; A47B 96/067;

(Continued)

(56) References Cited

U.S. PATENT DOCUMENTS

| | | | |
|---|---|---|---|
| 911,568 | A | 2/1909 | Bickford |
| 1,357,280 | A | 11/1920 | Dulle |

(Continued)

FOREIGN PATENT DOCUMENTS

| | | | |
|---|---|---|---|
| CN | 102358484 | A | 2/2012 |
| CN | 102747813 | B | 12/2014 |

(Continued)

OTHER PUBLICATIONS

Search Report in GB Patent Application No. GB1712474.4, dated Feb. 1, 2018; 3 pages.

(Continued)

*Primary Examiner* — Mark J Beauchaine

(74) *Attorney, Agent, or Firm* — Schmeiser, Olsen & Watts LLP

(57) ABSTRACT

Described is a retractable bagging station for use in a retail store. The bagging station includes a frame and a bag dispenser retractably coupled to the frame. The bag dispenser holds and dispenses shopping bags. The bag dispenser is retractably coupled to the frame such that the bag dispenser extends out of and retracts into the frame. The bagging station is retractable into the frame so that the bagging station can be stored in a retracted position under a counter, for example, when the bagging station is not needed. When the bagging station is needed, it can be extended out from the frame to be used. The bagging station can be mounted under a counter of a checkout station, for example, so the bagging station can be used at the checkout station when needed.

10 Claims, 11 Drawing Sheets

(58) Field of Classification Search
CPC ..... B65B 67/1266; B65B 67/1216; B65B 67/1227
See application file for complete search history.

(56) References Cited

U.S. PATENT DOCUMENTS

| | | | | |
|---|---|---|---|---|
| 2,270,796 | A | 1/1942 | Hauser | |
| 2,920,854 | A | 1/1960 | Morse, Jr. | |
| 2,925,916 | A | 2/1960 | Pollock | |
| 4,005,801 | A * | 2/1977 | Musser | B65B 43/14 221/56 |
| 4,199,122 | A | 4/1980 | Christie | |
| 4,305,558 | A | 12/1981 | Baker | |
| 4,949,924 | A | 8/1990 | Carmody | |
| 4,998,694 | A | 3/1991 | Barteaux | |
| 5,152,404 | A | 10/1992 | Salrin et al. | |
| 5,170,719 | A | 12/1992 | Pestone | |
| 5,395,080 | A | 3/1995 | Smith | |
| 5,437,346 | A | 8/1995 | Dumont | |
| 5,439,120 | A | 8/1995 | Brozak | |
| 5,465,846 | A | 11/1995 | Blyth et al. | |
| 5,485,932 | A | 1/1996 | Romm et al. | |
| 5,695,073 | A | 12/1997 | Klein et al. | |
| 6,042,063 | A | 3/2000 | Kerr et al. | |
| 6,089,514 | A | 7/2000 | Huang et al. | |
| 6,155,521 | A | 12/2000 | O'hanlon | |
| 6,267,334 | B1 | 7/2001 | Siu | |
| 6,543,638 | B2 | 4/2003 | Wile | |
| 6,726,156 | B1 | 4/2004 | Scola | |
| 7,530,537 | B2 | 5/2009 | Kandah | |
| 7,677,507 | B1 | 3/2010 | Rothbauer et al. | |
| 7,850,018 | B2 | 12/2010 | Galle | |
| 8,857,347 | B1 | 10/2014 | Liu et al. | |
| 2007/0228678 | A1 | 10/2007 | Solomon et al. | |
| 2010/0314507 | A1 | 12/2010 | Laitila et al. | |
| 2011/0266092 | A1 | 11/2011 | Marquis et al. | |
| 2012/0111810 | A1 * | 5/2012 | Tan | A47F 9/042 211/59.2 |
| 2015/0083677 | A1 | 3/2015 | Tan et al. | |
| 2015/0103539 | A1 | 4/2015 | Lee | |
| 2015/0226451 | A1 | 8/2015 | Crowley | |
| 2017/0172322 | A1 | 6/2017 | Bacallao | |

FOREIGN PATENT DOCUMENTS

| | | | |
|---|---|---|---|
| CN | 205402170 | U | 7/2016 |
| GB | 2200035 | A | 7/1988 |
| JP | 2015217972 | A | 12/2015 |
| WO | 2008054720 | A2 | 5/2008 |
| WO | 2015030704 | A2 | 3/2015 |

OTHER PUBLICATIONS

"Econoco sh/5h—5 Hook Faceour, Pack of 24, Econoco," Google.com/shopping, accessed on Oct. 16, 2015.
Search Report in UK Patent Application No. 1621383.7, dated Mar. 20, 2017; 5 pages.
Non-Final Office Action in U.S. Appl. No. 15/381,552, dated Jun. 16, 2017; 9 pages.
"Deck Joist Tie 14 Ga.," HomeDepot.ca, accessed on Apr. 27, 2017.
"Metal Building Materials C Z Purlin Wall Girt Manufacture," ADTOMall.com, accessed on Apr. 27, 2017.
"Tripp Lite 4U Hinged Wall Mount Patch Panel Bracket," Amazon.com, accessed on Apr. 27, 2017.
5-Opening 4 in.×6 in. Pallet Picture Frame, Pannacle, HomeDepot.com, accessed on Apr. 27, 2017.
"POS Check Out Plastic Bag Holder Dispenser for Retail Supermarket Brand New!" Ebay.com, accessed on Nov. 17, 2016; 5 pages.
"Lot 2 Royston Plastic Grocery Bag Holder Dispenser Stand Point of Sale Shopping," TeraPeak.com, accessed on Nov. 17, 2016; 3 pages.
"Bag Holders," ULINE.mx, accessed on Nov. 17, 2016; 1 page.
"OEM Express Checkout Counter / Customized Supermarket Cash Register Stands Counters," Guangzhou ECO Commerical Equipment Co., Ltd, SupermarketCheckoutCounters.com, accessed on Nov. 17, 2016; 3 pages.
Notice of Allowance in U.S. Appl. No. 15/381,552, dated Sep. 20, 2017; 8 pages.
Notice of Allowance for U.S. Appl. No. 15/666,942, dated Mar. 2, 2018, (9 pages).

* cited by examiner

RETRACTABLE BAGGING STATION

CROSS REFERENCE TO RELATED APPLICATION

This invention claims priority to U.S. provisional patent application Ser. No. 62/426,633, filed Nov. 28, 2016 to Applicant Wal-Mart Stores Inc., and entitled "Retractable Bagging station", which is incorporated entirely herein by reference.

BACKGROUND OF THE INVENTION

Technical Field

This invention relates to bagging stations for dispensing shopping bags in a retail store, and specifically to a bagging station with a bag dispenser that can be extended out from and retracted into a frame at a checkout station.

State of the Art

Bagging stations are commonly used at checkout stations of retail stores. A checkout station is a location in the retail store where customers bring items to pay for them and to put them in bags before leaving the retail store. A checkout station often includes a checkout register for receiving payment for the items to be purchased, and a bagging station for holding and dispensing shopping bags. The bagging station is often placed at the end of a checkout station counter at the checkout station. Items that have been purchased are put in a shopping bag at the bagging station. When the shopping bag is full, it is removed from the bagging station and another shopping bag is opened and filled until all items are bagged. A problem is that bagging stations tend to be large and take up quite a bit of room at the checkout station. There are some checkout stations in retail stores where the use of a bagging station is sporadic. It is desirable to be able to store a bagging station when not in use, so that the space can be used for other purposes.

Accordingly, what is needed is a bagging station that can be stored out of sight and out of the way when not being used at the checkout station.

DETAILED DESCRIPTION OF EMBODIMENTS OF THE INVENTION

As discussed above, embodiments of the present invention relate to bagging stations for dispensing shopping bags in a retail store, and specifically, to a bagging station with a bag dispenser that can be extended out from and retracted into a frame.

Bagging stations are in common use in retail stores for dispensing shopping bags at a checkout station. The bagging station includes a bag dispenser which holds and dispenses shopping bags. Bag dispensers are often fixedly mounted near the checkout station, and take up a considerable amount of space at the checkout station. What is needed is a bagging station that has a bag dispenser that can be retracted underneath a counter and extended only when needed. The retractable bagging station can be mounted at a checkout station, or underneath counters in other locations in a retail store. When a bagging station is needed, the bag dispenser can be extended out from underneath the counter and used to dispense shopping bags. When the bagging station is not needed, the bag dispenser can be retracted underneath the counter and will be out of the way, without taking up valuable floor space.

Disclosed is a checkout station for a retail store that includes a retractable bagging station. The checkout station includes a counter, and a bagging station mounted to the counter. The bagging station includes a frame mounted to a bottom surface of the counter, and a bag dispenser retractably coupled to the frame. The bag dispenser is retractably coupled to the frame such that the bag dispenser extends out of and retracts into the frame. In a specific embodiment, the bag dispenser is retractably coupled to the frame using at least one drawer slide. The bag dispenser holds and dispenses shopping bags. With the bag dispenser retracted into the frame, the bagging station takes up less room and can be stored under the counter. When the bag dispenser is extended from the frame, the bag dispenser can be used at the checkout station to dispense shopping bags.

Disclosed is a bagging station for a retail store that includes a frame, a bag dispenser, and a set of drawer slides. The drawer slides couple the bag dispenser to the frame such that the bag dispenser retracts into and extends out of the frame on the drawer slides. The bag dispenser holds and dispenses shopping bags.

Figure 1:
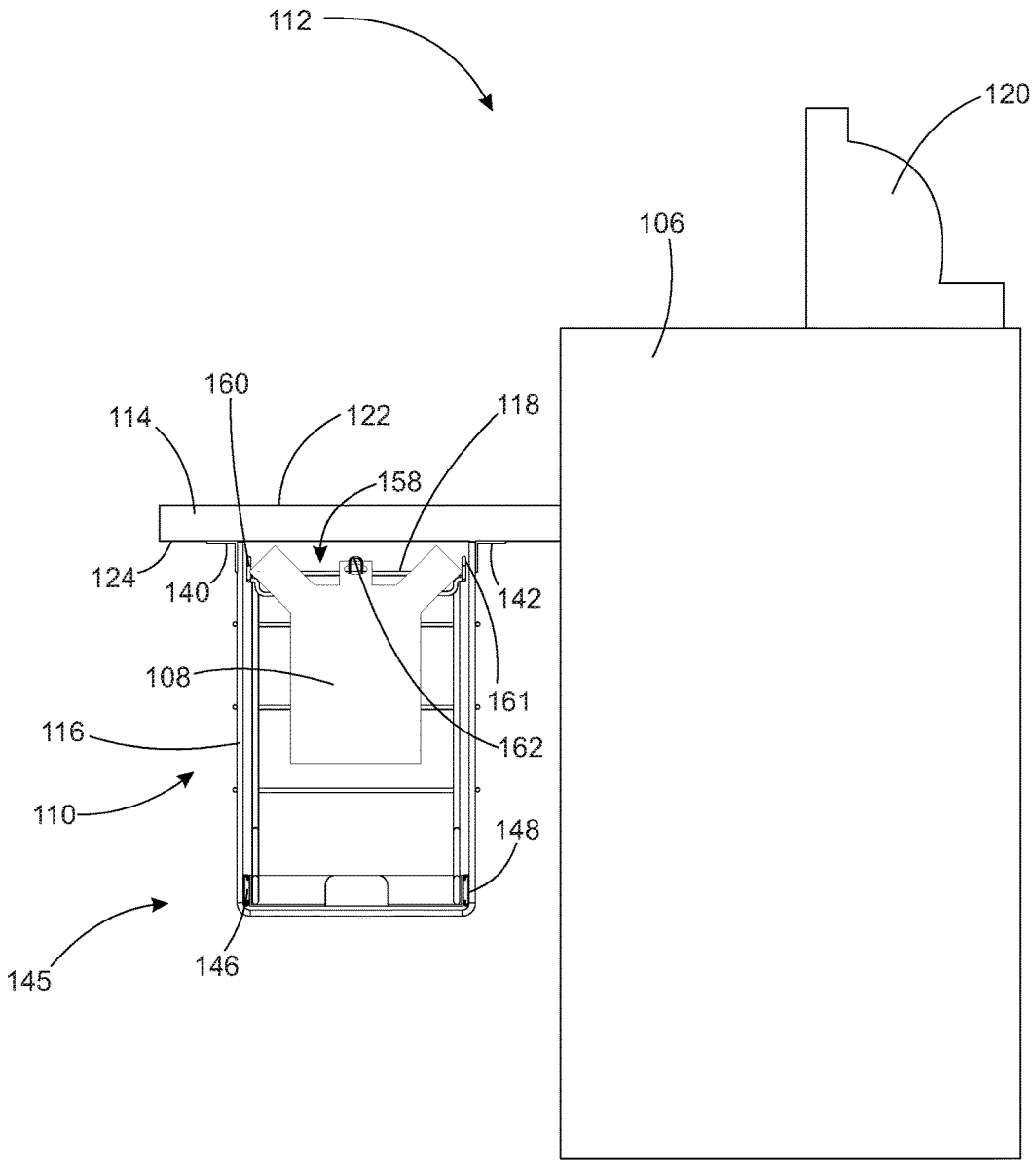
FIG. 1 shows a checkout station in a retail store with a retractable bagging station.
Figure 2:
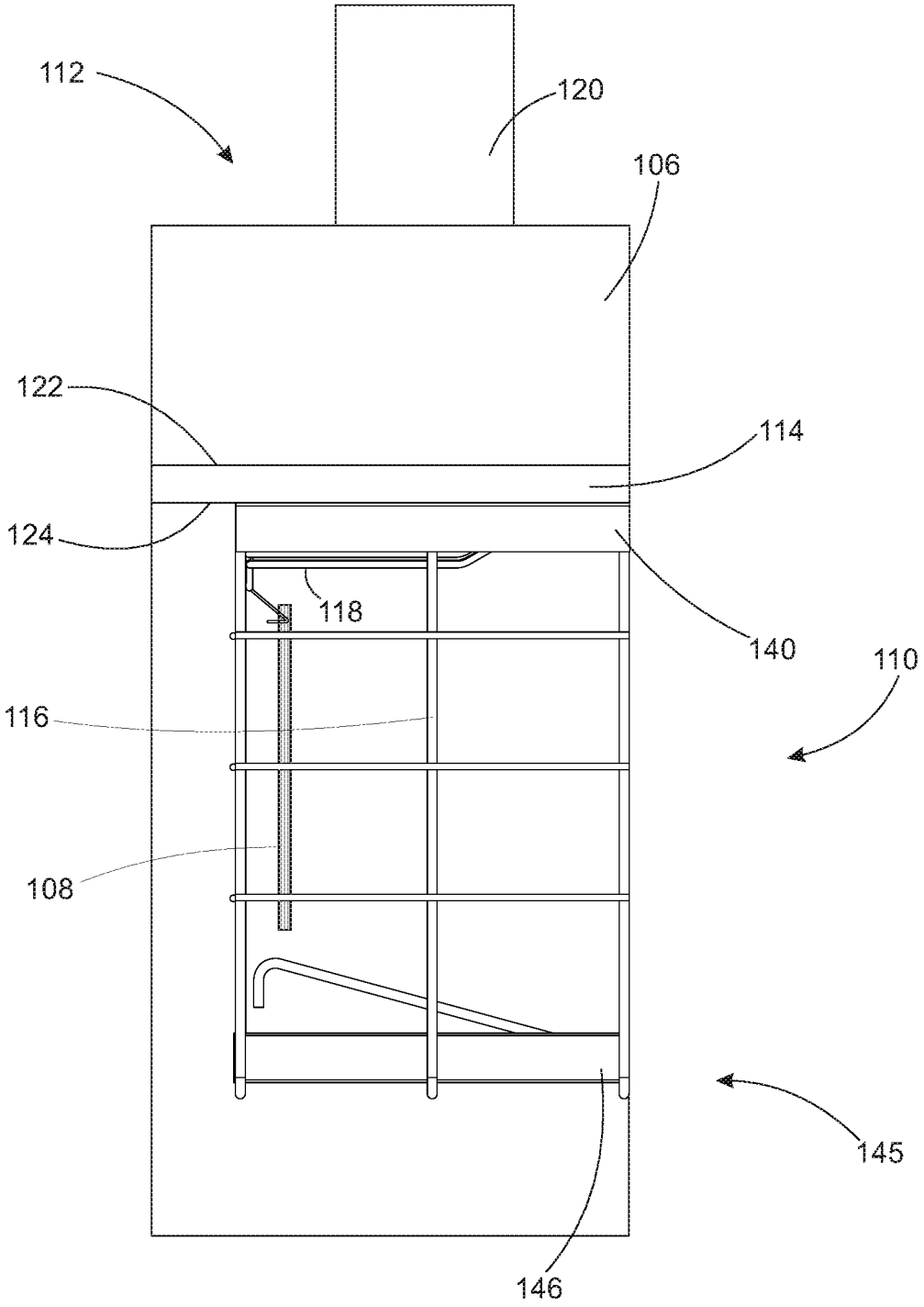
FIG. 2 shows a side view of the checkout station of FIG. 1 with a bag dispenser of the retractable bagging station in a retracted position.
Figure 3:
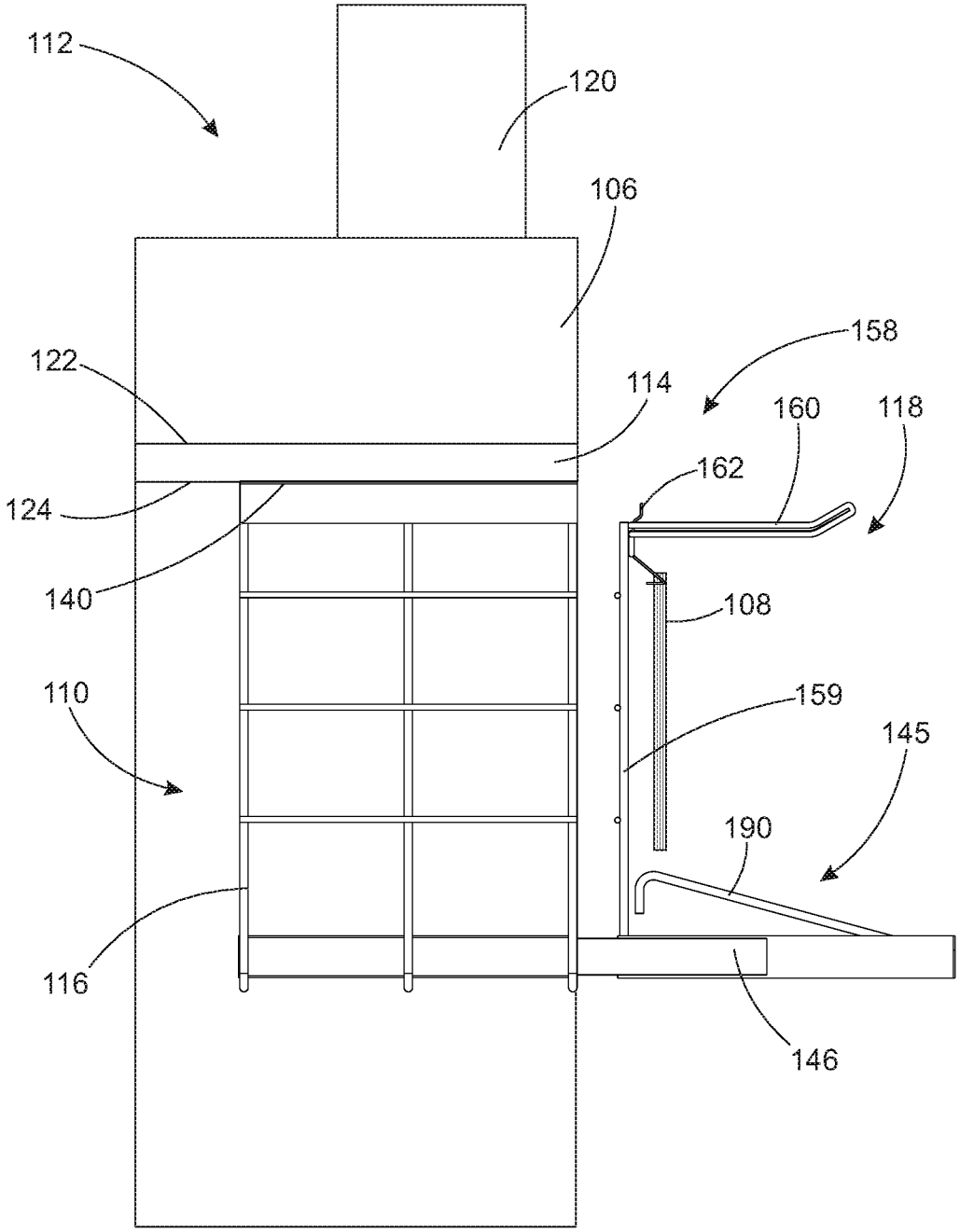
FIG. 3 shows a side view of the checkout station of FIG. 1, with the bag dispenser of the retractable bagging station in an extended position.

Disclosed is a bagging station that includes a means to dispense one or more shopping bags, and a means to retractably couple the means to dispense the one or more shopping bags to a checkout station of a retail store. In some embodiments, the means to retractably couple the means to dispense one or more shopping bags to a checkout station is a means to retractably couple the means to dispense one or more shopping bags to a counter of the checkout station. In some embodiments, the means to retractably couple the means to dispense one or more shopping bags to a checkout station is a means to retractably couple the means to dispense one or more shopping bags to a bottom surface of the counter of the checkout station FIG. 1 through FIG. 3 illustrate a retractable bagging station 110 for use in a retail store. FIG. 1 shows an end view of a checkout station 112 for a retail store, with bagging station 110 coupled to a counter 114 of checkout station 112. FIG. 2 shows a side view of checkout station 112, with bagging station 110 mounted beneath counter 114 of checkout station 112, and with a bag dispenser 118 retracted into a frame 116 of bagging station 110. FIG. 3 shows a side view of bagging station 110 mounted beneath counter 114, with bag dispenser 118 extended out of frame 116 of bagging station 110.

Customers who wish to purchase items in the retail store bring their items to be purchased to checkout station 112. Checkout station 112 includes a payment register 120 and a register support structure 106, see FIG. 1 through FIG. 3. Checkout station 112 also includes a counter 114 and a bagging station 110 coupled to counter 114. Bagging station 110 holds and dispenses shopping bags 108. When a customer bring items to be purchased to checkout station 112, a cashier collects payment using payment register 120. Once payment is received for the items to be purchased, the items can be bagged and removed from the retail store. Checkout station 112 includes counter 114 for setting items to be purchased on, and bagging station 110 for bagging items that are purchased. Counter 114 has a top surface 122 and a bottom surface 124. In this embodiment, bagging station 110 is coupled to bottom surface 124 of counter 114. In some embodiments, top surface 122 of counter 114 includes a conveyor belt for carrying items to be purchased.

It is to be understood that although FIG. 1 shows bagging station 110 mounted near, and used with, payment register 120, this is not meant to be limiting. Bagging station 110 can be mounted in many different locations in a retail store. Bagging station 110 can be mounted at locations away from a payment register so that customers who pay electronically do not need to visit a checkout station to bag their purchases, for example.

Figure 4:
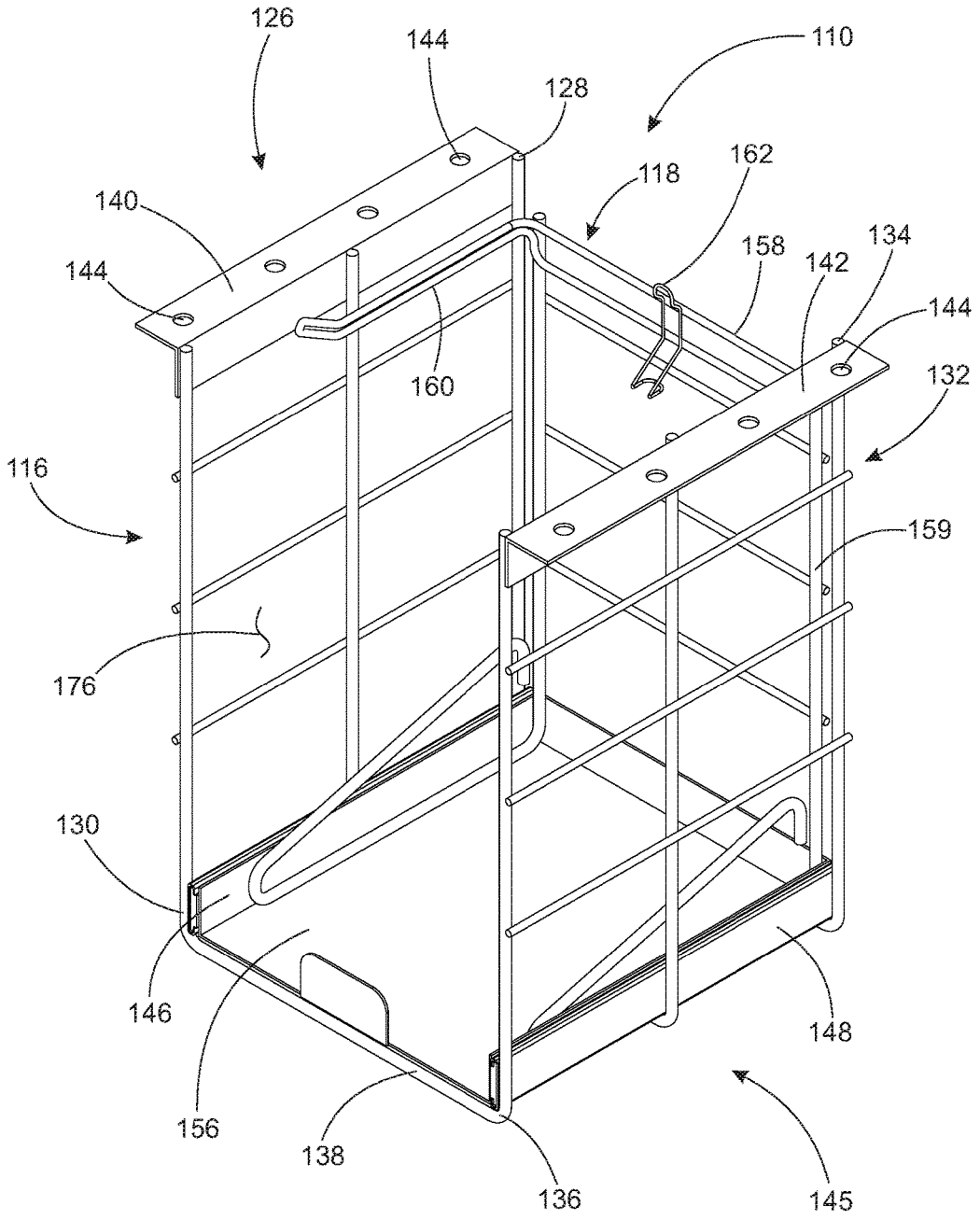
FIG. 4 shows a front perspective view of a retractable bagging station.
Figure 5:
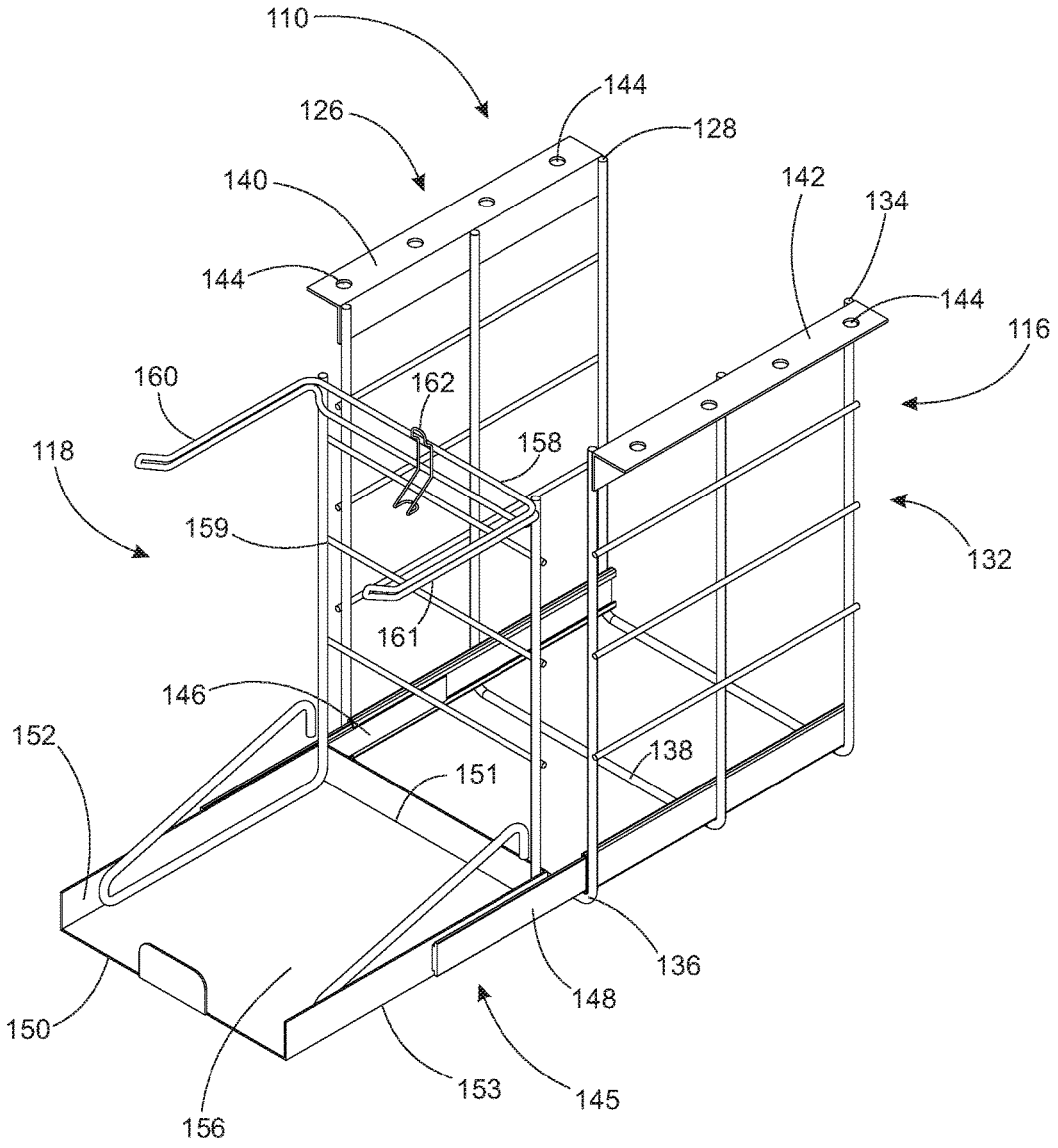
FIG. 5 shows a front perspective view of the retractable bagging station of FIG. 4 with a bag dispenser extended out from a frame of the retractable bagging station.
Figure 6:
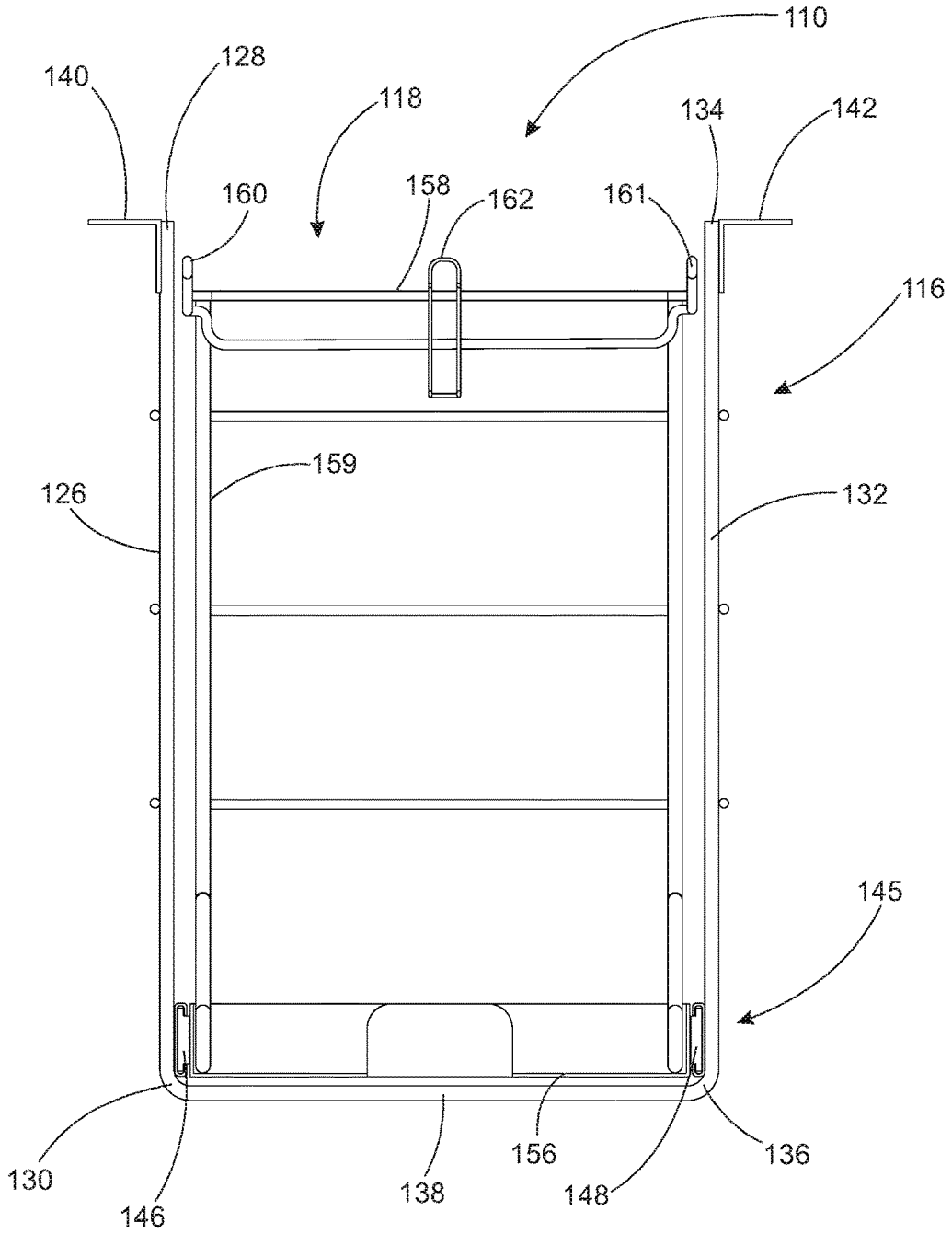
FIG. 6 shows a front view of the retractable bagging station of FIG. 4.
Figure 7:
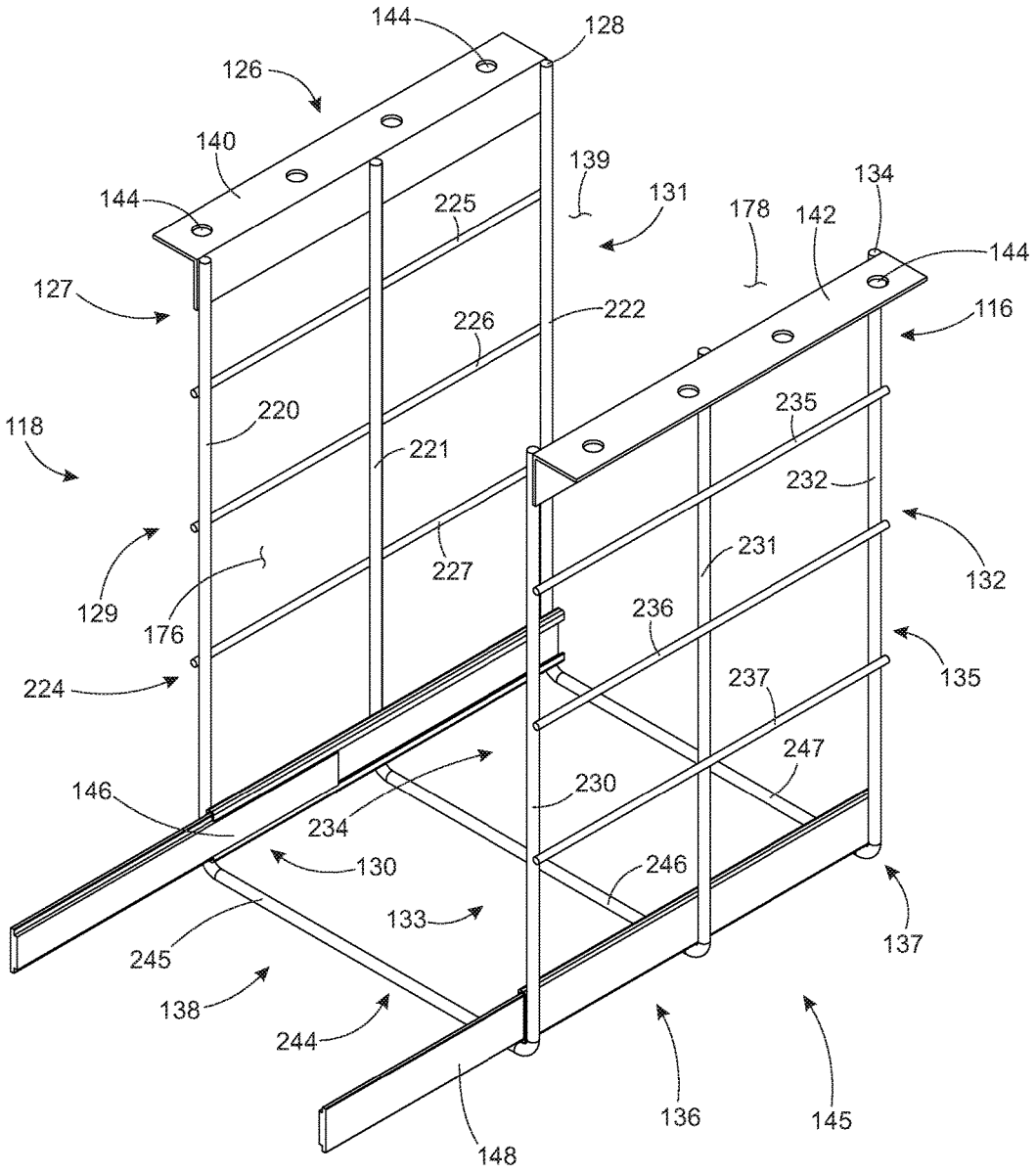
FIG. 7 shows a front perspective view of a frame of the retractable bagging station of FIG. 4.
Figure 8:
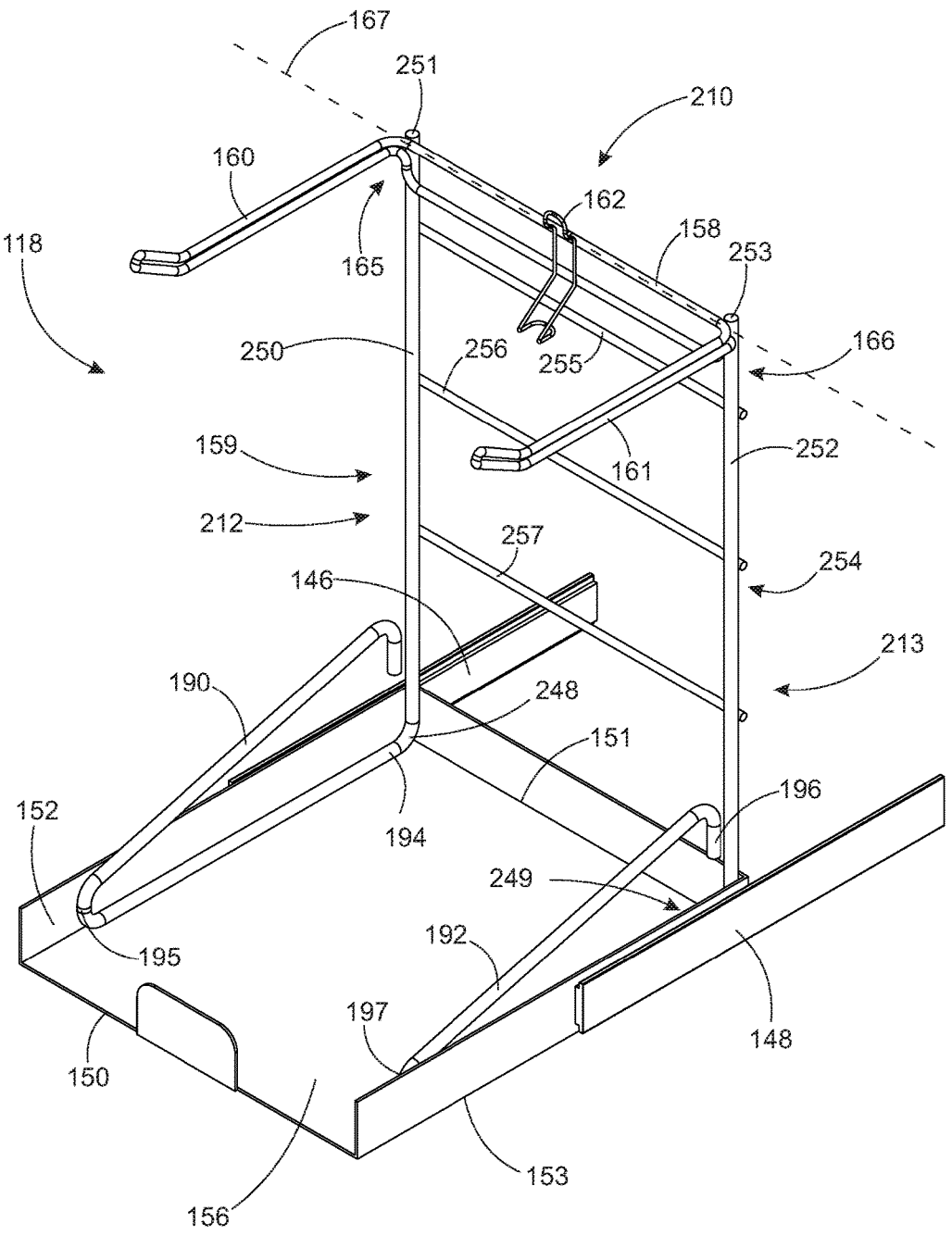
FIG. 8 shows a front perspective view of a bag dispenser of the retractable bagging station of FIG. 4.
Figure 9:
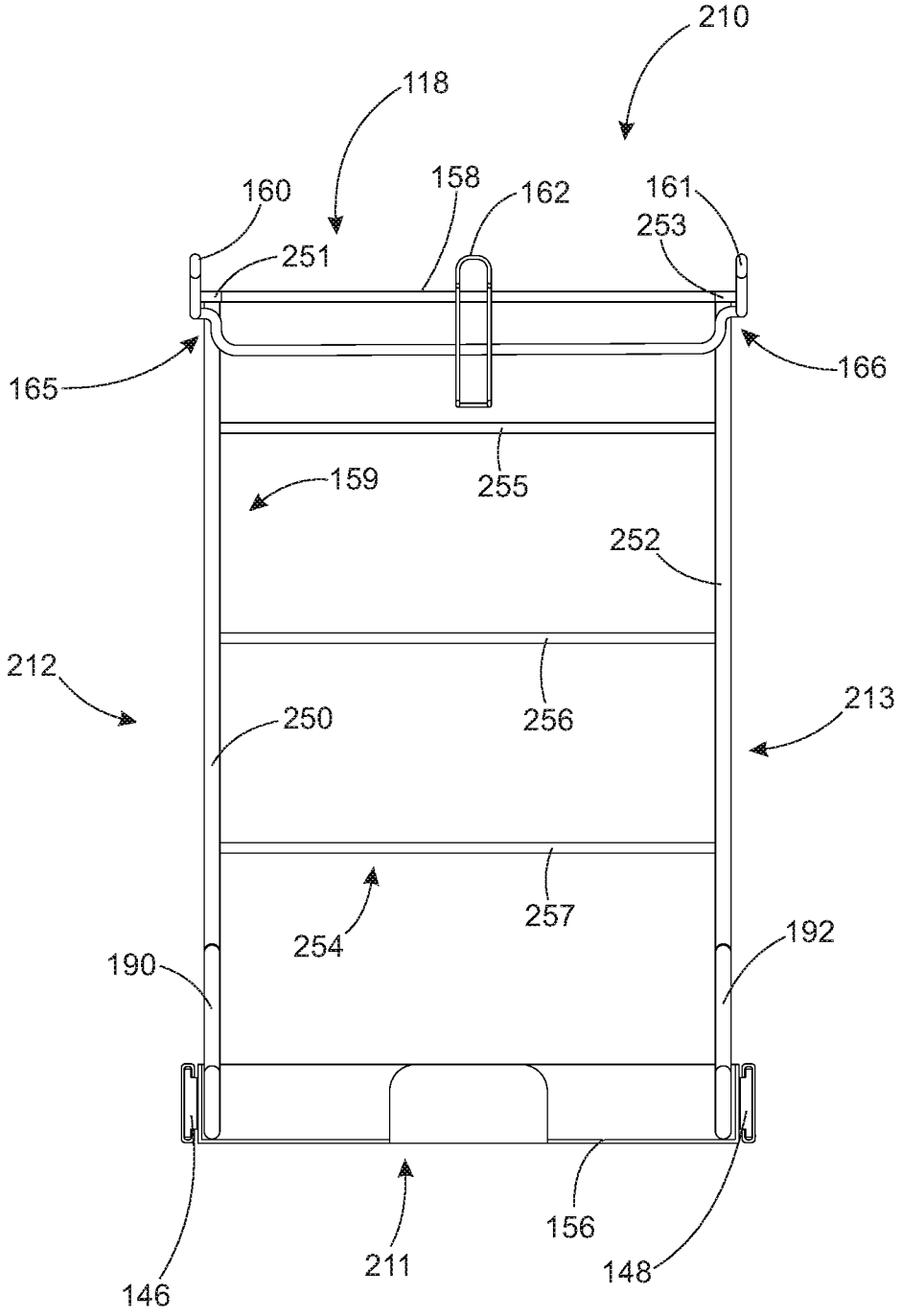
FIG. 9 shows a front view of the bag dispenser of FIG. 8.
Figure 10:
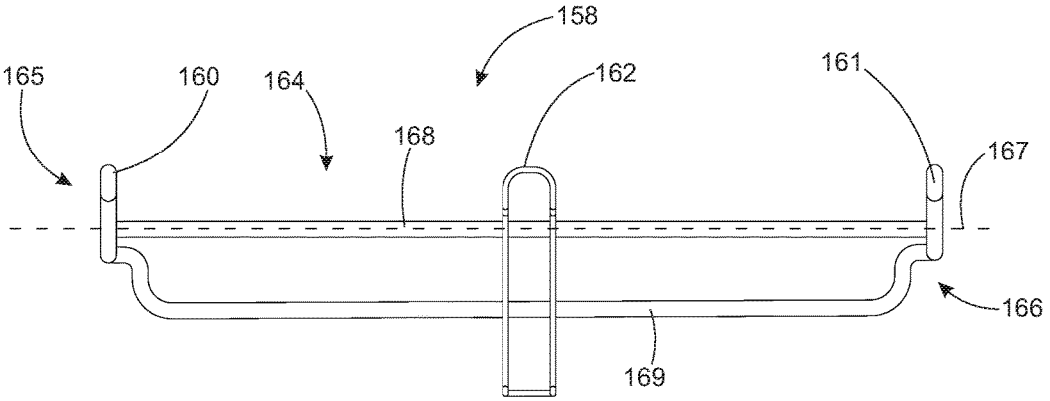
FIG. 10 shows a front view of a bag holder of the bag dispenser of FIG. 8.

FIG. 4 through FIG. 10 show details of bagging station 110. FIG. 4 shows a front perspective view of bagging station 110 with bag dispenser 118 in a retracted position. FIG. 5 shows a front perspective view of bagging station 110 with bag dispenser 118 in an extended position. FIG. 6 shows a front view of bagging station 110 with bag dispenser 118 in a retracted position. FIG. 7 shows a front perspective view of frame 116 of bagging station 110. FIG. 8 shows a front perspective view of bag dispenser 118 of bagging station 110. FIG. 9 shows a front view of bag dispenser 118. FIG. 10 is a front view of a bag holder 158 of bag dispenser 118.

Bagging station 110 includes frame 116, bag dispenser 118, and a set of drawer slides 145 that retractably couple bag dispenser 118 to frame 116. Bag dispenser 118 holds and dispenses shopping bags 108, as shown in FIG. 1 through FIG. 3. Frame 116 is configured to mount to counter 114 of retail store checkout station 112. Frame 116 is fixedly mounted to bottom surface 124 of counter 114, in this embodiment. Set of drawer slides 145 couple bag dispenser 118 to frame 116 and allow bag dispenser 118 to retract into and extend out of frame 116 on set of drawer slides 145. This allows bagging station 110 to be stored underneath counter 114 when bag dispenser 118 is in a retracted position, as shown in FIG. 2, FIG. 4 and FIG. 6. With bagging station in a retracted position under counter 114, bagging station 110 does not take up valuable space at checkout station 112. When bagging station 110 is needed to dispense shopping bags 108, bag dispenser 118 is extended from frame 116 into an extended position, as shown in FIG. 3 and FIG. 5, and bag dispenser 118 is used to dispense shopping bags 108. Bag dispenser 118 is stored in a retracted position when not needed, and extended when shopping bags 108 are needed.

Frame 116 is mounted to bottom surface 124 of counter 114 using a first L bracket 140 and a second L bracket 142, as shown in FIG. 1 through FIG. 6. Frame 116 includes a frame first side 126, a frame second side 132, and a frame bottom 138 (FIG. 4 through FIG. 7). Frame bottom 138 is coupled to frame first side 126 and frame second side 132. Frame 116 has an open frame top 139 (FIG. 7). Counter 114 serves as a top to frame 116 once frame 116 is mounted to counter 114. Frame 116 has an open frame front side 176 (FIG. 4 and FIG. 7) and an open frame back side 178 (FIG. 7). Bag dispenser 118 extends out of and retracts back into frame 116 through open frame front side 176, as shown in the figures.

Referring to FIG. 4 through FIG. 7, frame first side 126 has a frame first side top edge 128, a frame first side bottom edge 130, a frame first side front edge 129 (FIG. 7), and a frame first side rear edge 131 (FIG. 7). Frame first side 126 is formed of elongate rigid bars, made of metal in this embodiment, but many rigid materials can be used. Frame first side 126 includes a set of three frame first side vertical bars 127 (FIG. 7). Set of three frame first side vertical bars 127 includes a bar 220, a bar 221, and a bar 222, as shown in FIG. 7. Bars 220, 221, and 222 are parallel to each other in this embodiment and extend from frame first side top edge 128 to frame first side bottom edge 130. Frame first side 126 also includes a set of three frame first side horizontal bars 224 (FIG. 7). Set of three frame first side horizontal bars 224 includes a bar 225, a bar 226, and a bar 227, as shown in FIG. 7. Bars 225, 226, and 227 are parallel to each other in this embodiment and extend from frame first side front edge 129 to frame first side rear edge 131.

Frame second side 132 has a frame second side top edge 134, a frame second side bottom edge 136, a frame second side front edge 133 (FIG. 7), and a frame second side rear edge 135 (FIG. 7). Frame second side 132 is formed of elongate rigid bars, made of metal in this embodiment, but other rigid materials can be used. Frame second side 132 includes a set of three frame second side vertical bars 137. Set of three frame second side vertical bars 137 includes a bar 230, a bar 231, and a bar 232, as shown in FIG. 7. Bars 230, 231, and 232 are parallel to each other in this embodiment and extend from frame second side top edge 134 to frame second side bottom edge 136. Frame second side 132 also includes a set of three frame second side horizontal bars 234 (FIG. 7). Set of three frame second side horizontal bars 234 includes a bar 235, a bar 236, and a bar 237, as shown in FIG. 7. Bars 235, 236, and 237 are parallel to each other in this embodiment and extend from frame second side front edge 133 to frame second side rear edge 135.

Bottom 138 is coupled to both frame first side 126 and frame second side 132. Bottom 138 extends from frame first side bottom edge 130 to frame second side bottom edge 136. Bottom 138 is formed of a set of three frame bottom bars 244 that includes bar 245, bar 246, and bar 247, as shown in FIG. 7. Bars 245, 246, and 247 extend parallel to each other from frame first side bottom edge 130 to frame second side bottom edge 136.

Frame 116 is formed of a grid of metal bars in this embodiment, but this is not meant to be limiting. In some embodiments, frame 116 is formed of a grid or lattice of any rigid material. In some embodiments, frame 116 is formed of solid plates of rigid material. Frame 116 can be formed of any material that can encase bag dispenser 118, couple to bagging station 112, and allow bag dispenser 118 to extend from and retract into frame 116.

First L bracket 140 is coupled to frame first side top edge 128. Second L bracket 142 is coupled to frame second side top edge 134. First L bracket 140 and second L bracket 142 mount frame 116 and bagging station 110 to counter 114 (FIG. 1 through FIG. 3). First L bracket 140 mounts frame first side 126 to bottom surface 124 of counter 114. Second L bracket 142 mounts frame second side 132 to bottom surface 124 of counter 114. First and second L bracket 140 and 142 can be coupled to bottom surface 124 using many different types of couplers, including but not limited to screws, bolts, nails, staples, welds, etc. In this embodiment, a plurality of holes 144 in first and second L bracket 140 and 142 are used to bolt frame 116 to counter 114. In the embodiment shown, bagging station 110 is mounted to counter 114, but it is to be understood that bagging station 110 can be mounted to other fixtures of checkout station 112, or many other fixtures in the retail store. Bagging station 110 can be mounted to many different fixtures, tables, surfaces or other structures in the retail store.

Bag dispenser 118 is a means to hold and dispense one or more shopping bag 108 as shown in FIG. 1 through FIG. 3. Bag dispenser 118 extends out of and retracts into frame 116 on set of drawer slides 145. Bag dispenser 118 includes bag holder 158 that holds at least one shopping bag 108, a support frame 159, a first bottom brace 190, a second bottom brace 192, and a bottom plate 156, as shown in FIG. 4 through FIG. 6, and FIG. 8 through FIG. 10. FIG. 8 shows a front perspective view of bag dispenser 118 of bagging station 110. FIG. 9 shows a front view of bag dispenser 118. FIG. 10 is a front view of bag holder 158 of bag dispenser 118.

Bag dispenser 118 is retractably coupled to frame 116. Bag dispenser 118 retracts into and extends out of frame 116. FIG. 1, FIG. 2, and FIG. 4 show bag dispenser 118 in a retracted position, which is the position of bag dispenser 118 in which bag dispenser 118 is retracted into frame 116. FIG. 3 and FIG. 5 show bag dispenser 118 in an extended position, which is the position of bag dispenser 118 in which bag dispenser 118 is extended out of frame 116. In the embodiment shown in the figures, bag dispenser 118 is retractably coupled to frame 116 using set of drawer slides 145, but this is not meant to be limiting. In some embodiments, bag dispenser 118 is retractably coupled to frame 116 using other retractable hardware.

Bag dispenser support frame 159 is formed of a grid of rigid bars in this embodiment. Bag dispenser support frame 159 forms the skeletal frame for bag dispenser 118. Bottom plate 156, first bottom brace 190, second bottom brace 192, and bag holder 158 are each coupled to bag dispenser support frame 159. Bag dispenser support frame 159 has a bag dispenser support frame top edge 210, a bag dispenser support frame bottom edge 211, a bag dispenser support frame first side edge 212, and a bag dispenser support frame second side edge 213, see FIG. 8 and FIG. 9. Bag dispenser support frame 159 is formed of a grid of rigid bars, in this embodiment, but this is not meant to be limiting. Bag dispenser support frame 159, in this embodiment, includes a first support frame vertical bar 250 and a second support frame vertical bar 252, see FIG. 8 and FIG. 9. First support frame vertical bar 250 extends along bag dispenser support frame first side edge 212 from bag dispenser support frame top edge 210 to bag dispenser support frame bottom edge 211. Second support frame vertical bar 252 extends along bag dispenser support frame second side edge 213 from bag dispenser support frame top edge 210 to bag dispenser support frame bottom edge 211. Second support frame vertical bar 252 is parallel to first support frame vertical bar 250. Bag dispenser support frame 159 also includes a set of three support frame horizontal bars 254, that includes a bar 255, a bar 256, and a bar 257, see FIG. 8 and FIG. 9. Bar 255, 256 and 257 extend parallel to each other from bag dispenser support frame first side edge 212 to bag dispenser support frame second side edge 213.

Bag holder 158 is coupled to bag dispenser support frame top edge 210. Bag holder 158 holds shopping bags 108, see FIG. 1 through FIG. 3. Bag holder 158 is shown by itself in FIG. 10. Bag holder 158 includes a bag holder back frame 164, a first handler holder arm 160, a second handle holder arm 161, and a bag holder hook 162. One or more shopping bag 108 hang from bag holder hook 162 (FIG. 1) by the center hole in shopping bag 108. The handles of shopping bag 108 are held by first handle holder arm 160 and second handle holder arm 161, as shown in FIG. 1. An employee or customer of the retail store who wishes to fill a shopping bag opens one of shopping bags 108 while shopping bag 108 is hanging from bag holder 158 of bag dispenser 118. Purchased items are placed in shopping bag 108. Shopping bag 108 with the purchased items is supported by bottom plate 156 while being filled. Once shopping bag 108 is filled, it is removed from bag dispenser 118. If another shopping bag is needed, an additional shopping bag 108 is opened and filled with purchased items. In this way, bag dispenser 118 holds and dispenses one or more shopping bags 108.

Bag holder back frame 164 has a bag holder back frame first end 165 and a bag holder back frame second end 166 opposing back holder back frame first end 165, see FIG. 10. Bag holder back frame first end 165 is coupled to first support frame vertical bar 251 of first support frame vertical bar 250, see FIG. 8 and FIG. 9. Back holder back frame second end 166 is coupled to a second support frame vertical bar top end 253, of second support frame vertical bar 252, see FIG. 8 and FIG. 9. Back holder back frame 164 also has a longitudinal axis 167 (FIG. 10) that extends from bag holder back frame first end 165 to bag holder back frame second end 166. Back holder back frame 164 is formed of two elongate bars, a first support structure bar 168 and a second support structure bar 169. First and second support structure bars 168 and 169 extend parallel to each other and to bag holder back frame longitudinal axis 167 from bag holder back frame first end 165 (which is coupled to bag dispenser support frame first side edge 212) to back holder back frame second end 166 (coupled to bag dispenser support frame second side edge 213).

First handle holder arm 160, second handle holder arm 161, and bag holder hook 162 are each coupled to bag holder back frame 164. First handle holder arm 160 is an elongate member formed of rigid material. First handle holder arm 160 is coupled to back holder back frame first end 165. First handle holder arm 160 is perpendicular to both back holder back frame longitudinal axis 167 and first support frame vertical bar 250 (FIG. 8). Second handle holder arm 161 is an elongate member formed of rigid material. Second handle holder arm 161 is coupled to back holder back frame second end 166. Second handle holder arm 161 is perpendicular to both bag holder back frame longitudinal axis 167 and second support frame vertical bar 252. First and second handle holder arms 160 and 161 hold the handles of shopping bag 108 while shopping bag 108 is being filled.

Bag holder hook 162 is a hook-shaped element coupled to bag holder back frame 164. One or more shopping bags 108 are hung on bag holder hook 164 by their center hole. Bag holder hook 162 is coupled to bag holder back frame 164 about halfway between bag holder back frame first end 165 and bag holder back frame second end 166.

First and second bottom brace 190 and 192 are each elongate members that extend from bag dispenser support frame bottom edge 211, see FIG. 8. First and second bottom brace 190 and 192 are the skeletal structure of the bottom end of bag dispenser 118. First bottom brace 190 has a first bottom brace first end 194 coupled to a first support frame vertical bar bottom end 248. First bottom brace second end 195 opposes first bottom brace first end 194. First bottom brace 190 is coupled to and extends along a bottom plate first side edge 152, as shown in FIG. 8. First bottom brace 190 is the structural support for bottom plate 156 and first drawer slide 146.

Second bottom brace 192 has a second bottom brace first end 196 coupled to a second support frame vertical bar bottom end 249. Second bottom brace second end 197 opposes second bottom brace first end 196. Second bottom brace 192 is coupled to and extends along a bottom plate second side edge 153, as shown in FIG. 8. Second bottom brace 192 is the structural support for bottom plate 156 and second drawer slide 148.

Bottom plate 156 is coupled to first and second braces 190 and 192, see FIG. 8. Bottom plate 156 is formed of a sheet of rigid material. Bottom plate 156 provides support for shopping bag 108 and the items that are in shopping bag 108 as shopping bag 108 is hanging from bag dispenser 118 and being filled. Bottom plate 156 includes a bottom plate front edge 150, a bottom plate rear edge 151, a bottom plate first side edge 152, and a bottom plate second side edge 153.

Set of drawer slides 145 retractably couples bag dispenser 118 to frame 116. Set of drawer slides 145 includes a first drawer slide 146 and a second drawer slide 148. Set of drawer slides 145 is coupled to both bag dispenser 118 and frame 116. Bag dispenser 118 slides on set of drawer slides 145 to retract into and extend out of frame 116. Frame 116 and set of drawer slides 145 are a means to retractably couple bag dispenser 118 to counter 114. Frame 116 is fixedly mounted to counter 114, and bag dispenser 118 is retractably coupled to frame 116. In some embodiments, hardware other than frame 116 and/or set of drawer slides 145 are used to retractably couple bag dispenser 118 to counter 114.

First drawer slide 146 is coupled to bottom plate first side edge 152 of bottom plate 156 (FIG. 5 and FIG. 8). First drawer slide 146 is also coupled to first side bottom edge 130 of first side 126 of frame 116 (FIG. 4 and FIG. 7). First drawer slide 146 slidingly couples bottom plate 156 to first side 126 of frame 116. Second drawer slide 148 is coupled to bottom plate second side edge 153 of bottom plate 156 (FIG. 5 and FIG. 8). Second drawer slide 148 is also coupled to second side bottom edge 136 of second side 132 of frame 116 (FIG. 4 and FIG. 7). Second drawer slide 148 slidingly couples bottom plate 156 to second side 132 of frame 116. Bottom plate 156, and bag dispenser 118, slide on first drawer slide 146 and second drawer slide 148 of set of drawer slides 145 to extend out from and retract into frame 116.

With frame 116 mounted to bottom surface 124 of counter 114, and bag dispenser 118 retractably coupled to frame 116 using set of drawer slides 145, bagging station 110 is mounted beneath counter 114 and can be extended for use, or retracted for storage. Bag dispenser 118 slides on first drawer slide 146 and second drawer slide 148 to slide out of frame 116 to an extended position, as shown in FIG. 3 and FIG. 5. Bag dispenser 118 extends out of frame 116 through open frame front side 176. With bag dispenser 118 in an extended position, bag dispenser 118 can be used to dispense one or more shopping bag 108. A shopping bag 108 can be opened and purchased items can be put in shopping bag 108. Once shopping bag 108 is full, it will be removed with its contained items from bag dispenser 118. Another shopping bag 108 can be opened and filled if needed. Bag dispenser 118 slides on first drawer slide 146 and second drawer slide 148 to retract into frame 116 to a retracted position, as shown in FIG. 2 and FIG. 4. With bag dispenser 118 in a retracted position, bagging station 110 is contained underneath counter 114 and does not consume valuable space at or around checkout station 112.

Figure 11:
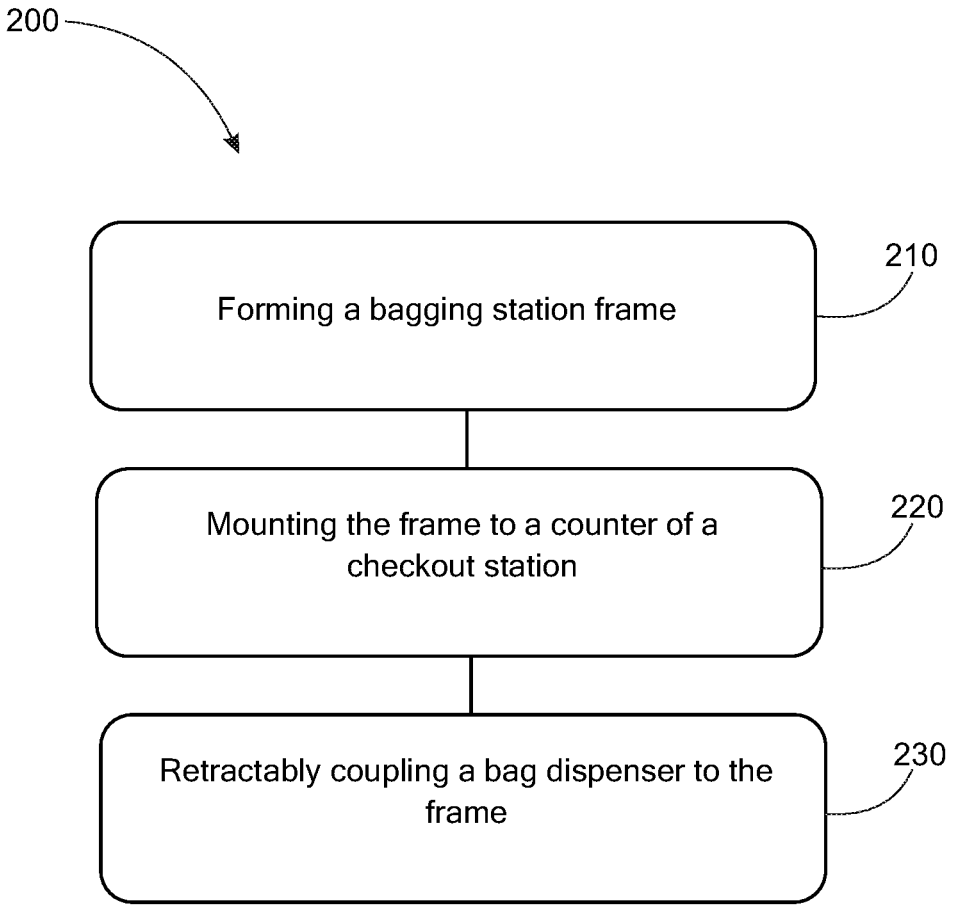
FIG. 11 illustrates a method of mounting a bagging station to a checkout station of a retail store.

FIG. 11 illustrates a method 200 of providing a bagging station for a checkout station of a retail store. Method 200 includes an act 210 of assembling (forming) a bagging station frame. Method 200 also includes an act 220 of mounting the frame to a counter of the checkout station. And method 200 includes an act 230 of retractably coupling a bag dispenser to the frame. Method 200 can include many other acts.

Act 210 of forming a bagging station frame can include many other acts. The bagging station frame includes a frame first side, a frame second side, and a frame bottom. The frame first side includes a frame first side top edge and a frame first side bottom edge. The frame second side includes a frame second side top edge and a frame second side bottom edge. The frame bottom is coupled to and extends between the frame first side bottom edge and the frame second side bottom edge.

The bagging station frame is the part of the bagging station that mounts to a counter or other structure. The bagging station frame does not move with respect to the counter or other structure. The bagging station frame encases the bag dispenser. The bag dispenser extends out from and retracts into the bagging station frame. In some embodiments, act 210 of forming a bagging station frame includes coupling the bottom to the first side and the second side. In some embodiments, act 210 includes coupling the bottom to a first side bottom edge, and coupling the bottom to a second side bottom edge. In some embodiments, act 210 of forming the bagging station frame includes coupling a first L bracket to a first side top edge, and coupling a second L bracket to a second side top edge. In some embodiments, forming a bagging station frame includes coupling a first drawer slide to the bottom, and coupling a second drawer slide to the bottom. In some embodiments, forming a bagging station frame includes coupling a first drawer slide to the first side bottom edge, and coupling a second drawer slide to the second side bottom edge.

Act 220 of mounting the frame to a counter of a checkout station can include many other acts. In some embodiments, act 220 includes mounting the frame to a bottom surface of the counter. In some embodiments, act 220 includes coupling the frame first side top edge to a bottom surface of the counter of the checkout station. In some embodiments, act 220 includes coupling the frame second side top edge to the bottom surface of the counter. In some embodiments, act 220 of mounting the frame to a counter of a checkout station includes coupling a first L bracket to the first side of the frame. In some embodiments, act 220 of mounting the frame to a counter of a checkout station includes coupling a second L bracket to the second side of the frame. In some embodiments, act 220 of mounting the frame to a counter of a checkout station includes mounting the first L bracket to a bottom surface of the counter. In some embodiments, act 220 of mounting the frame to a counter of a checkout station includes mounting the second L bracket to the bottom surface. In this embodiment, the frame is mounted to a counter of a checkout station, but in some embodiments, the frame is mounted to another structure in the retail store, such as a counter, table or frame at the checkout station or away from the checkout station.

Act 230 of retractably coupling the bag dispenser to the frame can include many other acts. The bag dispenser includes a bag dispenser support frame having a bag dispenser support frame top edge, a bag dispenser support frame bottom edge, a bag dispenser support frame first side edge, and a bag dispenser support frame second side edge. The bag dispenser also includes a bag holder coupled to the bag dispenser support frame top edge, a first and a second bottom brace each coupled to the bag dispenser support frame bottom edge, and a bottom plate coupled to the first and the second bottom braces. Act 230 of retractably coupling the bag dispenser to the frame allows the frame to extend from and retract into the frame. In some embodiments, act 230 of retractably coupling the bag dispenser to the frame includes retractably coupling the bag dispenser to the frame using a set of drawer slides. In some embodiments, act 230 of retractably coupling the bag dispenser to the frame includes coupling a first drawer slide to the frame first side bottom edge. In some embodiments, act 230 of retractably coupling the bag dispenser to the frame includes coupling the first drawer slide to the bottom plate. In some embodiments, act 230 of retractably coupling the bag dispenser to the frame includes coupling a second drawer slide to the frame second side bottom edge. In some embodiments, act 230 of retractably coupling the bag dispenser to the frame includes coupling the second drawer slide to the bottom plate. In some embodiments, act 230 of retractably coupling the bag dispenser to the frame includes coupling a first drawer slide to a first side of the frame. In some embodiments, act 230 of retractably coupling the bag dispenser to the frame includes coupling a second drawer slide to a second side of the frame. In some embodiments, act 230 of retractably coupling the bag dispenser to the frame includes coupling the bag dispenser to the first and the second drawer slide. In some embodiments, coupling the bag dispenser to the first and the second drawer slide includes coupling the first drawer slide to a bottom plate first side edge of the bottom plate. In some embodiments, coupling the bag dispenser to the first and the second drawer slide includes coupling the second drawer slide to a bottom plate second side edge of the bottom plate. In some embodiments, the bag dispenser is retractably coupled to the frame using devices other than drawer slides. The bag dispenser extends from and retracts into the frame on the drawer slides through an open front side of the bagging station frame.

Method 200 can include many other acts. In some embodiments, method 200 includes forming a bag dispenser. The bag dispenser is the portion of the bagging station that holds and dispenses shopping bags. In some embodiments, forming the bag dispenser includes forming a bag dispenser support frame. In some embodiments, the bag dispenser includes a bag dispenser support frame, a bag holder, a first and a second bottom brace, and a bottom plate. The bag holder includes a bag holder back frame, a first bag holder arm, a second bag holder arm, and a bag holder hook. The bag holder hook holds one or more shopping bags, and the first and the second bag holder arm hold the handles of the shopping bags. In some embodiments, forming the bag dispenser includes coupling the bottom plate to the first and the second bottom brace. In some embodiments, forming the bag dispenser includes coupling a first drawer slide to the bottom plate. In some embodiments, forming the bag dispenser includes coupling a second drawer slide to the bottom plate.

A retractable bagging station has been shown and described. The retractable bagging station includes a frame and a bag dispenser. The frame is mounted to a structural element on a retail store, such as a counter of a bagging station. The bag dispenser is slidably and retractably coupled to the frame such that the bag dispenser extends out from and retracts back into the frame. The bag dispenser is stored in a retracted position in the frame. The bag dispenser is extended out from the frame for use.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A retail store bagging station comprising:

a frame, wherein the frame is configured to mount to a counter of a retail store checkout station,
and wherein the frame comprises:
a frame first side, wherein the frame first side comprises:
a frame first side top edge;
a frame first side bottom edge;
a frame first side front edge;
a frame first side rear edge;
a set of three frame first side vertical bars extending parallel to each other from the frame first side top edge to the frame first side bottom edge;
a set of three frame first side horizontal bars extending parallel to each other from the frame first side front edge to the frame first side rear edge; and
a first L bracket coupled to the frame first side top edge;
a frame second side, wherein the frame second side comprises:
a frame second side top edge;
a frame second side bottom edge;
a frame second side front edge;
a frame second side rear edge;
a set of three frame second side vertical bars extending parallel to each other from the frame second side top edge to the frame second side bottom edge;
a set of three frame second side horizontal bars extending parallel to each other from the frame second side front edge to the frame second side rear edge; and
a second L bracket coupled to the frame second side top edge;
a frame bottom coupled to the frame first side and the frame second side, wherein the frame bottom comprises a set of three frame bottom bars that extend parallel to each other from the frame first side bottom edge to the frame second side bottom edge;
an open frame front side; and
an open frame back side;

a bag dispenser, wherein the bag dispenser is configured to hold and dispense at least one shopping bag, and wherein the bag dispenser comprises:
a bag dispenser support frame having a bag dispenser support frame top edge, a bag dispenser support frame bottom edge, a bag dispenser support frame first side edge, and a bag dispenser support frame second side edge;

a bag holder coupled to the bag dispenser support frame top edge;

a first and a second bottom brace each coupled to the bag dispenser support frame bottom edge; and a bottom plate coupled to the first and the second bottom braces; and a set of drawer slides that couple the bag dispenser to the frame, wherein the bag dispenser retracts into and extends out of the frame on the set of drawer slides.

2. The retail store bagging station of claim 1, wherein the bag dispenser retracts into and extends out of the frame through the open frame front side.

3. The retail store bagging station of claim 1, wherein the set of drawer slides comprises:

a first drawer slide coupled to the frame first side bottom edge; and a second drawer slide coupled to the frame second side bottom edge.

4. The retail store bagging station of claim 3, wherein the bag dispenser support frame comprises:

a first support frame vertical bar, wherein the first support frame vertical bar extends from the bag dispenser support frame top edge to the bag dispenser support frame bottom edge along the bag dispenser support frame first side edge;

a second support frame vertical bar, wherein the second support frame vertical bar extends from the bag dispenser support frame top edge to the bag dispenser support frame bottom edge along the bag dispenser support frame second side edge, and wherein the second support frame vertical bar is parallel to the first support frame vertical bar; and a set of three support frame horizontal bars, wherein each one of the set of three support frame horizontal bars extend parallel to each other from the bag dispenser support frame first side edge to the bag dispenser support frame second side edge.

5. The retail store bagging station of claim 4, wherein the bag holder comprises:

a bag holder back frame comprising:

a bag holder back frame first end coupled to a first support frame vertical bar top end;

a bag holder back frame second end coupled to a second support frame vertical bar top end;

a bag holder longitudinal axis that extends from the back holder back frame first end to the bag holder back frame second end;

a first support structure bar; and a second support structure bar;

wherein the first and the second support structure bar extend parallel to each other and to the bag holder longitudinal axis from the bag holder back frame first end to the bag holder back frame second end;

a first handle holder arm coupled to and extending from the bag holder back frame first end, wherein the first handle holder arm is perpendicular to both the bag holder longitudinal axis and the first support frame vertical bar;

a second handle holder arm coupled to and extending from the bag holder back frame second end, wherein the second handle holder arm is perpendicular to both the bag holder longitudinal axis and the second support frame vertical bar; and a bag holder hook coupled to and extending from the bag holder back frame between the bag holder back frame first end and the bag holder back frame second end.

6. The retail store bagging station of claim 5, wherein:

the bottom plate is formed of a sheet of rigid material having a bottom plate front edge, a bottom plate rear edge, a bottom plate first side edge, and a bottom plate second side edge;

the first drawer slide is coupled to the bottom plate first side edge; and the second drawer slide is coupled to the bottom plate second side edge.

7. The retail store bagging station of claim 6, wherein:

the first bottom brace comprises an elongate member with a first bottom brace first end and a first bottom brace second end opposing the first bottom brace first end;

the first bottom brace first end is coupled to a first support frame vertical bar bottom end;

the first bottom brace is coupled to and extends along the bottom plate first side edge in a direction perpendicular to the first support frame vertical bar;

the second bottom brace comprises an elongate member with a second bottom brace first end and a second bottom brace second end opposing the second bottom brace first end;

the second bottom brace first end is coupled to a second support frame vertical bar bottom end; and the second bottom brace is coupled to and extends along the bottom plate second side edge in a direction perpendicular to the second support frame vertical bar.

8. A checkout station for a retail store, the checkout station comprising:

a counter; and a bagging station comprising:

a frame, wherein the frame is mounted to a bottom surface of the counter, and wherein the frame comprises:

a frame first side comprising:

a frame first side top edge;

a frame first side bottom edge; and a first L bracket coupled to the frame first side top edge, wherein the first L bracket mounts the frame first side to the bottom surface of the counter;

a frame second side comprising:

a frame second side top edge;

a frame second side bottom edge; and a second L bracket coupled to the frame second side top edge, wherein the second L bracket mounts the frame second side to the bottom surface of the counter;

an open frame front side; and a frame bottom coupled to and extending between the frame first side bottom edge and the frame second side bottom edge;

a set of drawer slides coupled to the frame, wherein the set of drawer slides comprises:

a first drawer slide coupled to the frame first side bottom edge; and a second drawer slide coupled to the frame second side bottom edge;

wherein the bag dispenser retracts into and extends out of the frame through the open frame front side; and a bag dispenser coupled to the set of drawer slides, wherein the bag dispenser extends out of and retracts into the frame on the set of drawer slides, and wherein the bag dispenser holds and dispenses at least one shopping bag, and wherein the bag dispenser comprises:

a bag dispenser support frame comprising:

a bag dispenser support frame top edge;

a bag dispenser support frame bottom edge;

a bag dispenser support frame first side edge;

a bag dispenser support frame second side edge;

a first support frame vertical bar, wherein the first support frame vertical bar extends from the bag dispenser support frame top edge to the bag dispenser support frame bottom edge along the bag dispenser support frame first side edge;

a second support frame vertical bar, wherein the second support frame vertical bar extends from the bag dispenser support frame top edge to the bag dispenser support frame bottom edge along the bag dispenser support frame second side edge, and wherein the second support frame vertical bar is parallel to the first support frame vertical bar; and a set of three support frame horizontal bars, wherein each one of the set of three support frame horizontal bars extend parallel to each other from the bag dispenser support frame first side edge to the bag dispenser support frame second side edge;

a bag holder coupled to the bag dispenser support frame top edge;

a first and a second bottom brace each coupled to the bag dispenser support frame bottom edge; and a bottom plate coupled to both the first and the second bottom braces, wherein the bottom plate is formed of a sheet of rigid material having a bottom plate front edge, a bottom plate rear edge, a bottom plate first side edge, and a bottom plate second side edge;

wherein the first drawer slide couples the frame first side bottom edge to the bottom plate first side edge; and wherein the second drawer slide couples the frame second side bottom edge to the bottom plate second side edge.

9. The checkout station of claim 8, wherein the bag holder comprises:

a bag holder back frame comprising:

a bag holder back frame first end coupled to a first support frame vertical bar top end;

a bag holder back frame second end coupled to a second support frame vertical bar top end;

a bag holder longitudinal axis extending from the bag holder back frame first end to the bag holder back frame second end;

a first support structure bar; and a second support structure bar;

wherein the first and the second support structure bars extend parallel to each other and to the bag holder longitudinal axis from the bag holder back frame first end to the bag holder back frame second end;

a first handle holder arm coupled to and extending from the bag holder back frame first end, wherein the first handle holder arm is perpendicular to both the bag holder longitudinal axis and the first support frame vertical bar;

a second handle holder arm coupled to and extending from the bag holder back frame second end, wherein the second handle holder arm is perpendicular to both the bag holder longitudinal axis and the second support frame vertical bar; and a bag holder hook coupled to and extending from the bag holder back frame between the bag holder back frame first end and the bag holder back frame second end, wherein the at least one shopping bag hangs from the bag holder hook.

10. The checkout station of claim 9, wherein:

the first bottom brace comprises an elongate member with a first bottom brace first end and a first bottom brace second end opposing the first bottom brace first end;

the first bottom brace first end is coupled to a first support frame vertical bar bottom end;

the first bottom brace is coupled to and extends along the bottom plate first side edge in a direction perpendicular to the first support frame vertical bar;

the second bottom brace comprises an elongate member with a second bottom brace first end and a second bottom brace second end opposing the second bottom brace first end;

the second bottom brace first end is coupled to a second support frame vertical bar bottom end; and the second bottom brace is coupled to and extends along the bottom plate second side edge in a direction perpendicular to the second support frame vertical bar.

* * * * *